US005637823A

United States Patent [19]

Dodge

[11] Patent Number: 5,637,823

[45] Date of Patent: Jun. 10, 1997

[54] INTERCHANGEABLE ELECTRONICS MODULAR ELECTRIC STRINGED INSTRUMENT

[76] Inventor: Matthew Dodge, 2120 Longview Dr., Tallahassee, Fla. 32303

[21] Appl. No.: 544,321

[22] Filed: Oct. 17, 1995

[51] Int. Cl.[6] ..... G10H 1/32; G10H 1/34

[52] U.S. Cl. ..... 84/743; 84/726

[58] Field of Search ..... 84/726, 727, 743, 84/745

[56] References Cited

U.S. PATENT DOCUMENTS

| | | | |
|---|---|---|---|
| 4,425,831 | 1/1984 | Lipman . | |
| 4,854,210 | 8/1989 | Palazzolo . | |
| 4,872,386 | 10/1989 | Betticare . | |
| 5,029,511 | 7/1991 | Rosendahl . | |
| 5,252,777 | 10/1993 | Allen . | |
| 5,517,891 | 5/1996 | Sica | 84/453 |

FOREIGN PATENT DOCUMENTS 2599881 12/1987 France .

*Primary Examiner*—David S. Martin
*Assistant Examiner*—Marlon Fletcher
*Attorney, Agent, or Firm*—Peter Loffler

[57] ABSTRACT

An interchangeable electronics, modular, electric stringed instrument, having a cavity formed through the instrument body beneath the strings to house the pickups and other electronic components. The rear insertion modules provide rapid exchange and simultaneous regrouping of pickups and electronic components. Placement of a module into the instrument automatically positions the pickups beneath the strings, with the module being retained in the body by a flange formed in the instrument body. The module is removably secured in the instrument body by resiliently biased latches, which also function as spacers between the module and instrument body, and connect the electronic components installed in the module to a grounding plate in the instrument body. The interchangeable modules require no external fasteners and can be readily exchanged.

22 Claims, 5 Drawing Sheets

10
12
44
38
24
38
14

INTERCHANGEABLE ELECTRONICS MODULAR ELECTRIC STRINGED INSTRUMENT

BACKGROUND OF THE INVENTION

1. Field of the Invention

This invention relates to the field of electric stringed instruments and, more particularly to an instrument comprising interchangeable, electronics-containing modules which are fitted into an instrument body.

2. Discussion of the Related Art

Stringed instrument electronics are comprised of magnetic pickups arranged beneath the strings of guitars and like instruments, and having other electronic components which facilitate obtaining desired qualities of tonality, loudness, reverberation and timbre, qualities referred to in this discussion as 'sound' and 'tonal qualities'. Potentiometers regulate tonal qualities and volume. Switches regulate the electronic signal between pickups or different tonal qualities within the same pickup. Vibrations in the strings of a guitar induce electric signals in the coils of the pickup which are modified by switches and potentiometers and transmitted through the output wires from the guitar to an amplifier. Modification of musical sound utilizing different pickup designs and complementary electronic components can be achieved by the regrouping of pickups and electronic components.

Originally, electric guitar players had few choices in pickups giving different tonal qualities. Changes in styles of music and advances in pickup design, however, have spawned a large electronic market with many manufacturers, each producing numerous pickups. But, there has heretofore been no way for guitar players to conveniently have available to them a choice between various sounds in a single instrument, and guitarists have typically acquired numerous guitars, each with a particular electronic installation which produces distinct tonal qualities.

The exchange of guitar electronics in the known guitars generally requires technical assistance that is costly and time-consuming. Guitar players having technical expertise may exchange pickups and electronics themselves by removing the strings, unscrewing the casement for each pickup, installing the new pickups and restringing. Then, from the back of the guitar, they may remove a panel covering a relatively small cavity formed in the guitar body, and access electronic components which are installed through the back. Thus, each electronic component may be replaced individually and wired to the pickups.

The following U.S. patents suggest two approaches toward the replacement of pickups in guitars: U.S. Pat. No. 4,425,831 to Lipman, U.S. Pat. No. 5,029,511 to Rosendahl, U.S. Pat. No. 4,872,386 to Betticare, U.S. Pat. No. 5,252,777 to Allen, and U.S. Pat. No. 4,854,210 to Palazzolo. First, to obtain a modified musical sound without simply purchasing a new instrument or replacing the electronics as described above, the replacement of pickups can be achieved through a small opening in the back of the guitar which extends all the way through the body, permitting replacement of only one pickup at a time. Secondly, utilizing several shallow chambers in the front of the guitar permits the replacement of one or several pickups. But using either of these approaches, other electronic components are not replaced, and a full choice of desired tonal qualities is not provided.

An exchangeable guitar module which houses the electronic components and facilitates regrouping of electronic components is disclosed in French Patent No. 2-599-881. The disclosed device permits lateral insertion of an electronics module into a cut-out in the guitar body of equivalent depth as the module, but not cut entirely through the guitar body. Once installed via a groove in the guitar body and bolted, the device becomes integral to the structure of the guitar. The electronics-containing device is contiguous with the outside of the guitar body.

The disclosed French device has a number of significant disadvantages. Many of today's popular guitar body styles can be outfitted with lateral exchange devices only by having a separate module style for each body type. The lateral exchange device is bolted to the guitar body, requiring fastening tools external to the module, making this device not rapidly interchangeable. Also, securing the device to the guitar body via a groove cut into the guitar affords little space for natural expansion of materials due to changes in humidity and temperature.

One factor that has limited the development of rear entry interchangeable electronic modules is that typical guitar body construction is not conducive to having a large cavity or hole formed through the instrument without reducing the structural integrity of the guitar, so that the guitar body can fully withstand the tension placed on it by taut guitar strings. A cavity routed all the way through the guitar and made large enough to accommodate several pickups and all of the other electronic components would have a perimeter relatively close to the bridge and to the bottom of the fretboard on the neck. If such a cavity or hole was made in a conventional guitar design, a weak area would be created on either side where the neck connects to the guitar. For example, in conventional construction, three boards are glued together laterally to form the body of the guitar, and while the centerboard may also extend from the body to become the neck, many guitars have a bolt-on or glued in neck. In all three of these designs, if a large cavity is routed into the guitar body beneath the strings and extended laterally to accommodate a module containing not only the pickups but also the switches, wiring and potentiometers, the remaining wood mass would not be sufficient to support the tension of the strings, and the instrument would bow inward, thus raising the strings away from their normal position above fretboard, making the instrument unplayable.

For the foregoing reasons, there has been a need for a rear entry interchangeable electronics module for increased rapidity of electronic exchange, a module that would be placed into a cavity formed in the instrument body, such that the pickups would be automatically positioned beneath the strings without requiring time consuming removal of the strings or the individual exchange of pickups and electronic components, while maintaining the structural integrity of the instrument body and offering versatility by insertion into many body styles. Further, there has been a need for a rear insertion module having a sufficient thickness to accommodate installation of all of the electronic components on the current market, including the deeply set five way switch. To overcome the potential adverse effect on the structure of the instrument body of conventional wood construction by creating a large cavity between the bridge and fretboard, the use of a wide centerboard, neck-through-body construction would be desirable. Such a construction is occasionally utilized in custom-made guitars by laterally laminating different wood pieces on either sides of the pickup casements for the purpose of enhancement of the aesthetic qualities of the instrument. The use of a wide centerboard not simply for aesthetic reasons but for increased structural support, along with other significant modifications in typical guitar construction, comprise a design strategy for a rear insertion modular instrument, which will become clear in the description of the current invention.

SUMMARY OF THE INVENTION

The present invention has been made in view of the above-described disadvantages associated with the known electric stringed instruments and has as an object to provide a rear entry modular instrument with improved instrument body construction and exchangeable electronics module construction.

It is another object of the present invention to provide a convenient and fast exchange of instrument pickups and associated electronic components simultaneously by the use of interchangeable modules.

It is a further object of the present invention to provide interchangeable electronic modules which can be placed into different electric stringed instrument body constructions.

It is still further an object of the present invention to provide a module that is not an integral part of the structure of the instrument.

It is another object of the present invention to provide a module and instrument body construction which maintains the structural integrity and aesthetic appearance of the instrument.

It is yet another object of the present invention to provide a module which is easily fitted into an instrument body and is capable of accommodating an expansion of instrument and module materials.

It is further an object of the present invention to provide a module which maintains the aesthetic and utilitarian qualities of the front of the instrument.

It is still further an object of the present invention to provide a module requiring no external tools and fasteners for securing to an instrument body.

It is a yet still further object of the present invention to provide a module of sufficient thickness to accommodate the conventional electronic components manufactured for electric stringed instruments.

The electric stringed instrument, in accordance with a preferred embodiment of the present invention, comprises a body having a front face and a rear face. A cavity extends between the front face and the rear face.

The cavity is of a shape and size to removably receive modules which comprise the pickups and associated electronic components. The modules are preferably retained in the cavity by resiliently biased latches. Once installed, the module is automatically grounded. Different modules may be provided with an instrument to offer a choice between distinct selected sounds.

DETAILED DESCRIPTION OF PREFERRED EMBODIMENTS

The present invention comprises electric stringed instruments including the electric guitar, the bass guitar, the electric mandolin and the like. For illustrational purposes only, the drawings and descriptions herein refer only to the electric guitar.

Figure 1:
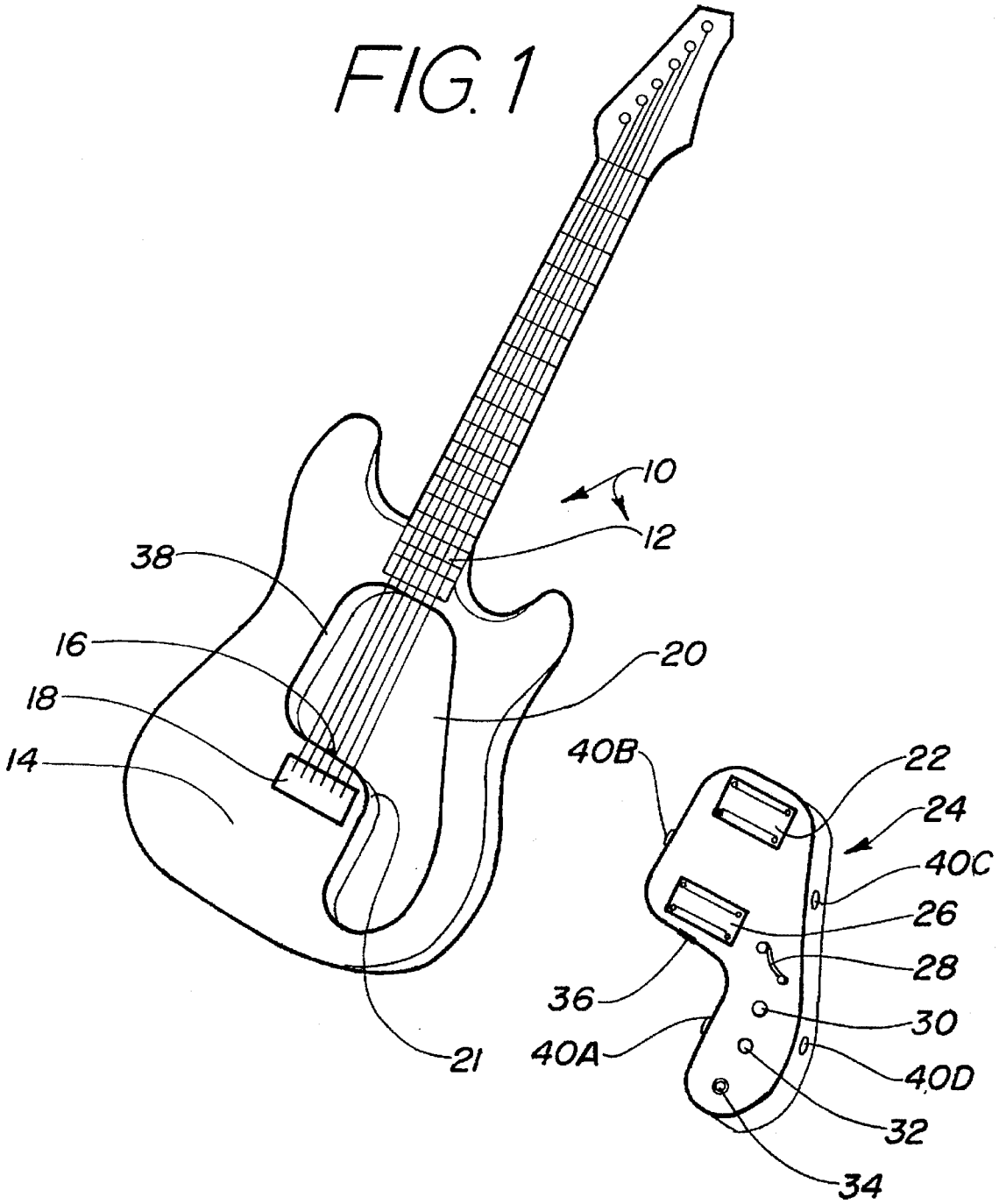
FIG. 1 is an exploded view showing the manner of installing a module in an interchangeable modular guitar in accordance with the present invention.

FIG. 1 illustrates a guitar 10 in accordance with the invention. The guitar 10 comprises a guitar body 14 and a module cavity 20 preferably formed through the entire thickness of the instrument. A module 24, containing the pickups, wiring and electronic components is shown as removed from the body 14. The module 24 may be constructed of wood, plastic or any other suitable material. The module 24 is inserted through the back face 60 (FIG. 3) of the guitar body 14 and is stopped from extending beyond the front face 62 (FIG. 3) of the guitar body 14 by a flange 38 which is part of the guitar body 14 and runs the entire perimeter of the module cavity 20.

Figure 2:
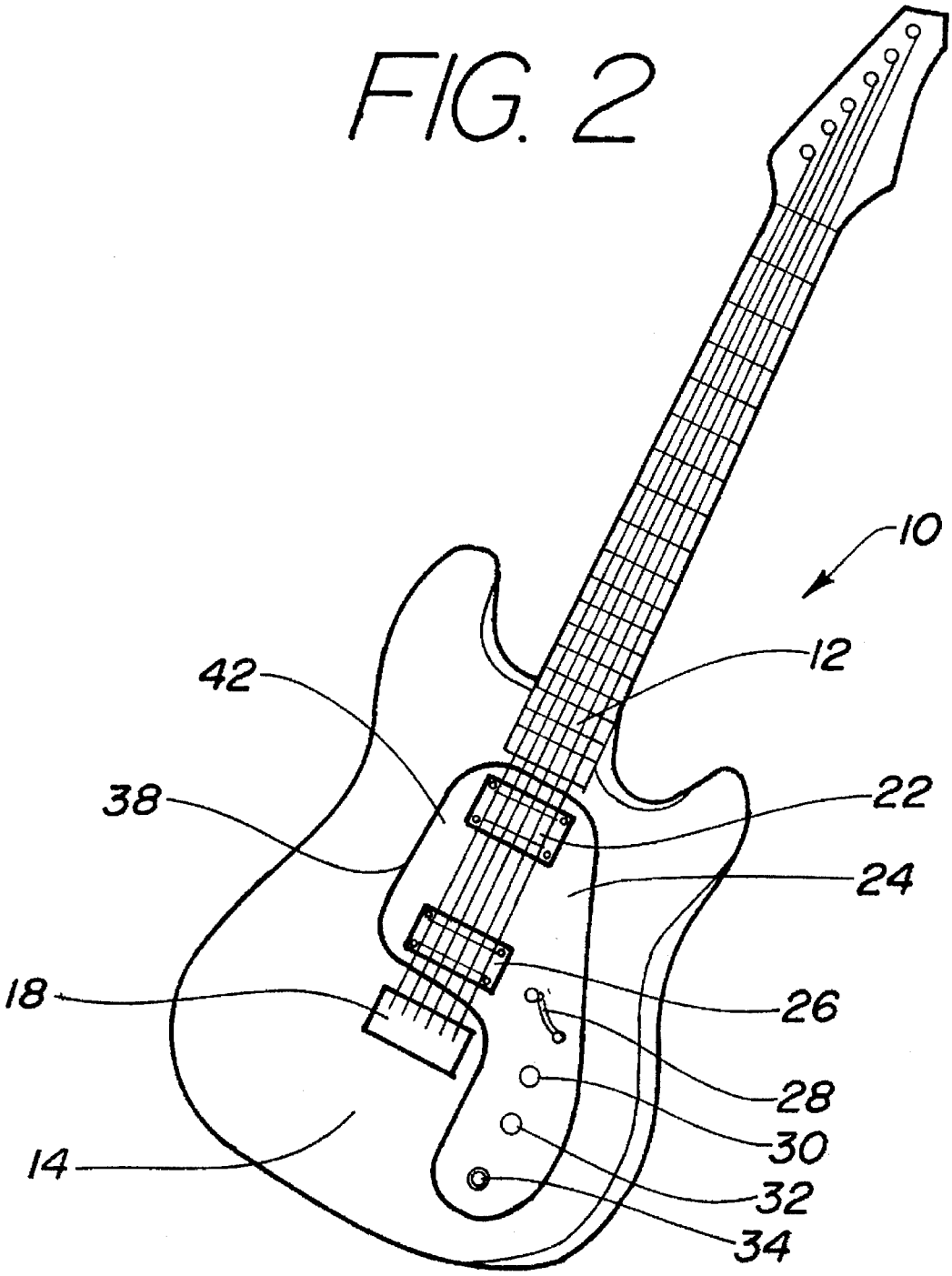
FIG. 2 is a front view of the interchangeable electric modular guitar of FIG. 1 with the module installed.
Figure 3:
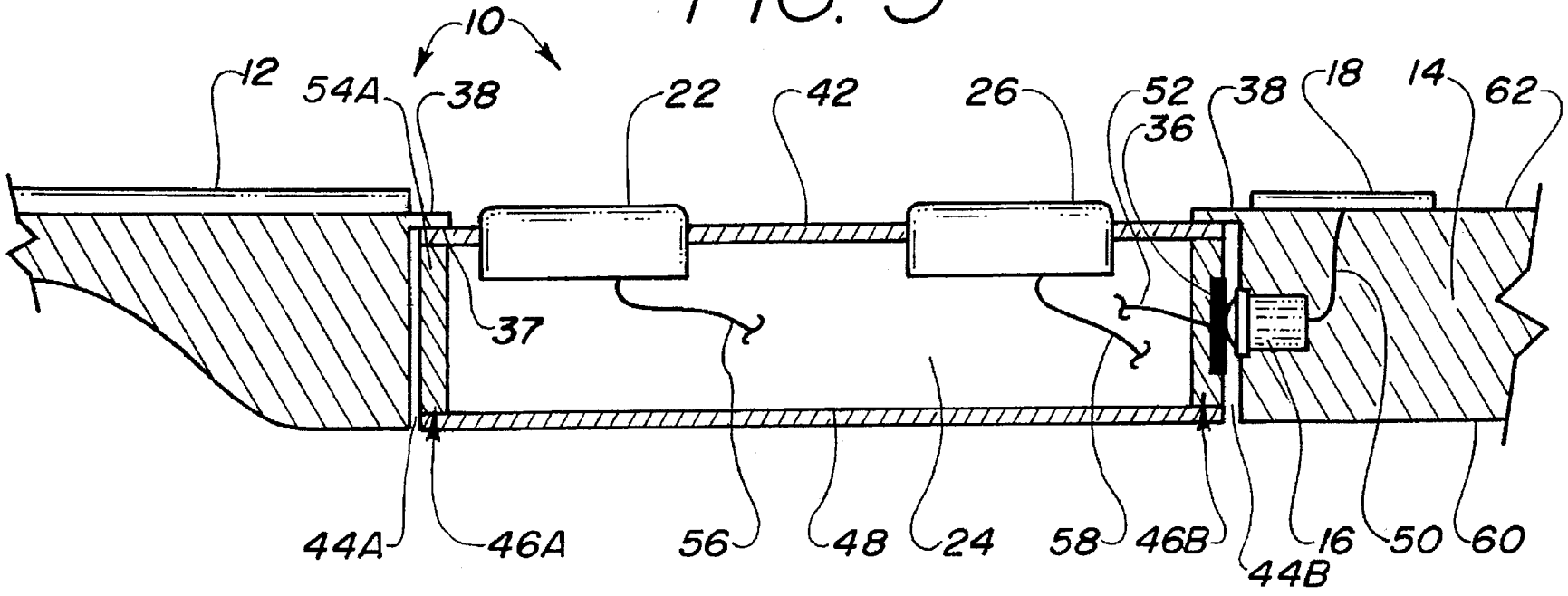
FIG. 3 is a partial cross-sectional view in the direction of line 3—3 of FIG. 2.

Resiliently biased spring latches 40*a*, 40*b*, 40*c*, and 40*d* are provided on the module 24 and function both as spacers and as a securing mechanism between the module cavity 20 and the module 24. These latches are preferably bullet type latches or pressure-securing latches. Latch 16 is provided on the wall 21 of the cavity 20 and functions as a spacer between the module cavity 20 and the module 24 and also as a grounding conduit between a bridge 18 and the electronic components in the module 24. Referring to FIG. 3, the latch 16 is wired to the bridge 18 and presses against a metal plate 36 embedded in a wall 46*b* of the module 24. The metal plate 36 is attached to a ground wire 52 from the module electronics. Once the module 24 is inserted in the guitar body 14, the ground is complete. FIG. 2 illustrates the module 24 as installed in the guitar body 14, with the front face 42 of the module 24 shown with pickups 22 and 26, a switch 28, a volume control 30, a tone control 32 and a jack 34. The front face 42 of the module 24 abuts the bottom face 37 of the flange 38 and is maintained in position as shown in FIG. 3, which illustrates a partial cross-sectional view of the guitar 10 and the module 24.

The module 24 is inserted through the back of the guitar body 14 as depicted in FIGS. 1 and 2, and is maintained in position by the flange 38. The module 24 houses the pickups 22 and 26, with electronic wiring 56 and 58 being connected to the electronic components (FIG. 2) namely, the switch 28, the volume control 30, the tone control 32 and the input jack 34. In accordance with the invention, each interchangeable module permits the regrouping of varying types of pickups and electronics.

A ground wire 52 extends from the electronics to the metal plate 36. The bullet latch 16 presses against the metal plate 36 and is connected by a ground wire 50 to the bridge 18, as illustrated.

The flange 38 is formed from a lip on the guitar body 14 and extends approximately ¼ in. inwards into the module cavity 20. The flange 38 has a thickness of approximately ⅛ in. The module 24 preferably has a thickness equivalent to the guitar body 14 less the flange 38. The front face 42 of the module 24 abuts the bottom face 37 of the flange 38 when the module 24 is inserted, and the back face 48 of the module 24 is substantially flush with the rear face 60 of the guitar body 14.

The front face 42 of the module 24 is permanently attached to the side walls 54*a* and 54*b* of the module 24, and the back face 48 is preferably removable via fasteners 46*a* and 46*b* to enable installation or servicing of different pickups and electronic components in any given module, if desired. For rapid exchange of pickups and electronic components, however, interchangeable modules, each having a different electronic installation is preferred. Thus, by having a single instrument and multiple modules, a variety of distinct sounds are achieved through the exchange of modules, and an infinite variety of combinations of pickups and electronics is provided.

In the preferred embodiment, an expansion space 44A and 44B of approximately 1/16 in. is provided surrounding the module 24 to facilitate the easy insertion and removal of the module 24 and accommodate natural dimensional changes in materials in dry and humid environments.

A fretboard 12 is illustrated on the guitar which is not a part of this invention.

Figure 4:
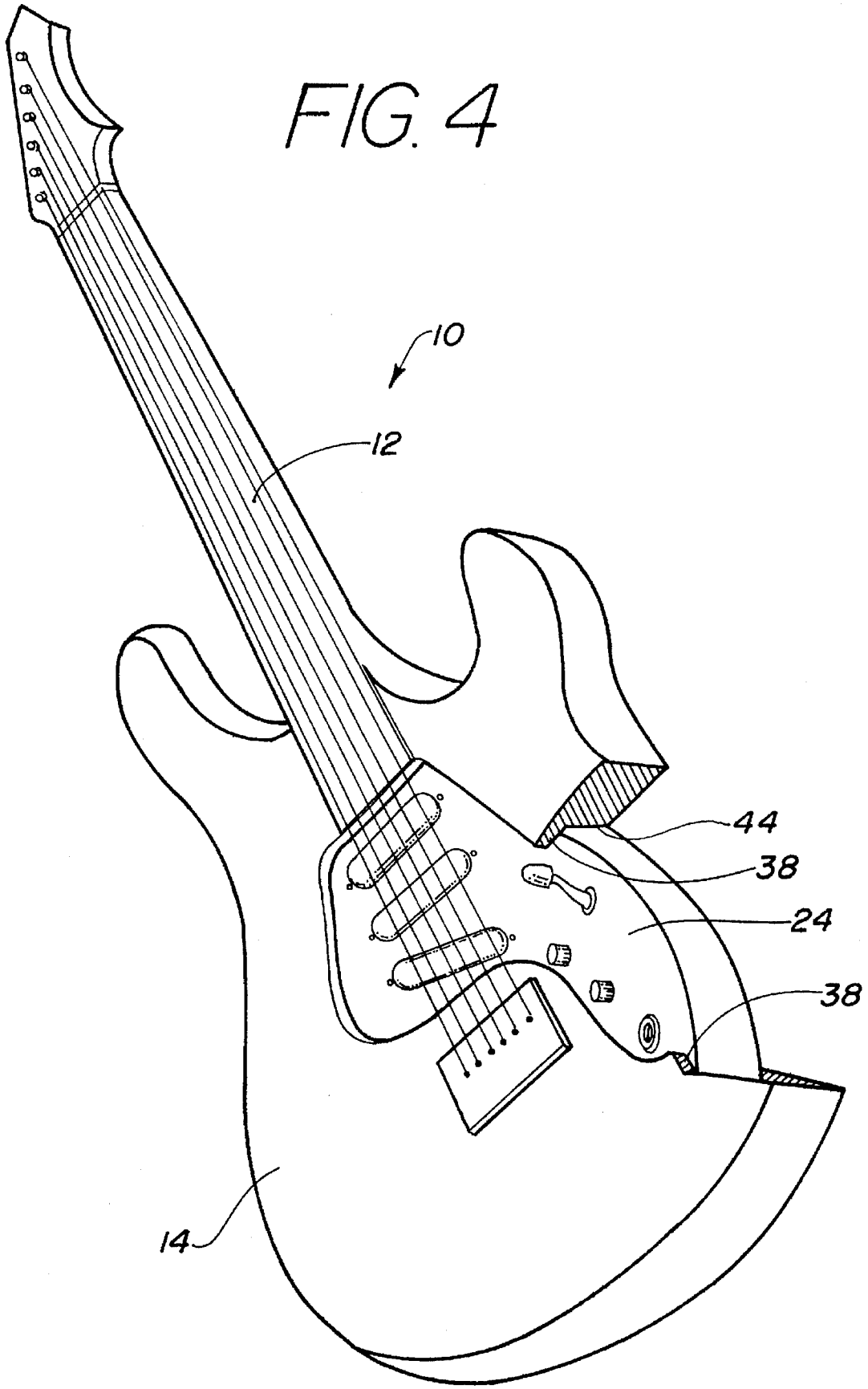
FIG. 4 is a partially broken away front perspective view of the modular guitar with a module installed in the guitar body and retained by a small flange contiguous with the instrument body.

FIG. 4 illustrates a cutaway view of the guitar 14 with the installed module 24, showing the flange 38 and the expansion space 44. With the module 24 inserted into the rear of the guitar body 14, the pickups and electronics are automatically positioned in the guitar 10 without removal or loosening of the strings.

Figure 5:
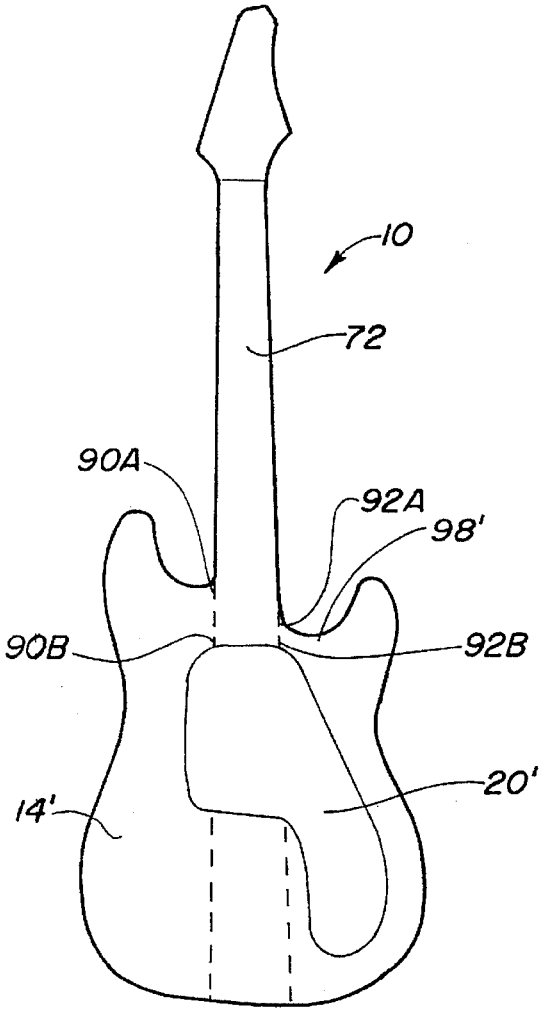
FIG. 5 illustrates a cavity formed in a conventional neck-through-body style guitar.

FIG. 5 depicts a guitar 10' having conventional neck-through-body construction with a narrow, tapered centerboard 72 which functions as the neck. As shown, the centerboard is inserted completely through the guitar body 14'. The module cavity 20' is formed in the guitar body 14', and the length of the glue joints, represented in dotted lines from positions 90*a* to 90*b* and 92*a* to 92*b*, are necessarily cut short. Thus, the wood mass between the module cavity 20' and the guitar body perimeter 98' is insufficient to support the tension of the strings (not shown) and the guitar will bow inward and the strings be raised significantly above the normal playing position, making the instrument unplayable.

Figure 6:
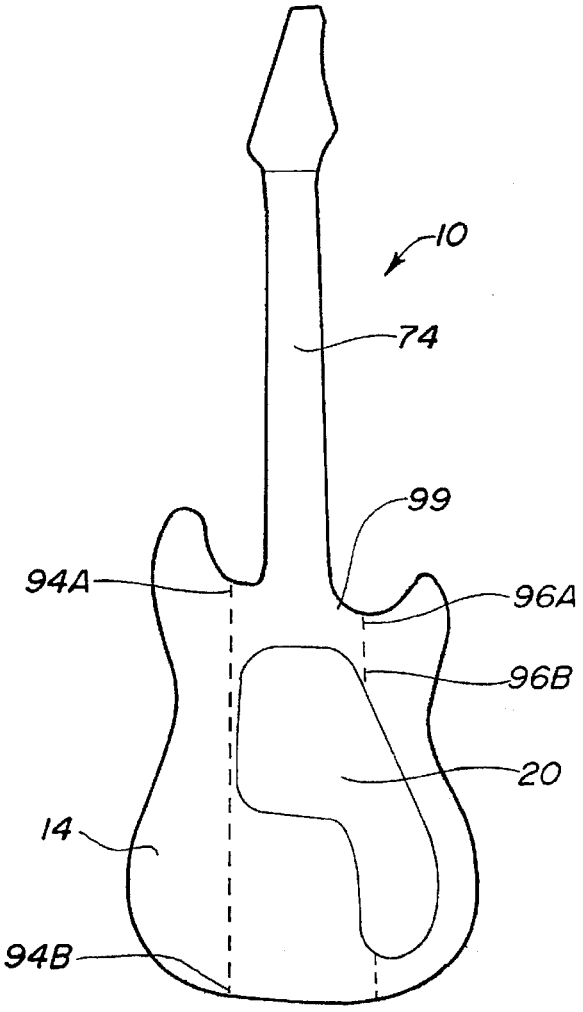
FIG. 6 illustrates a cavity formed in the neck-through-body guitar of the present invention.

FIG. 6 shows the improved neck-through-body construction of the present invention which provides a stronger body through the use of a relatively wider centerboard 74, which lengthens the glue joints 94*a* to 94*b* and 96*a* to 96*b* by moving them further from the longitudinal center, making them more stable. Additionally, by making a shallower radial contour in the guitar body perimeter 99, more wood mass is provided, enhancing the strength and stability of this area. Thus the improved neck-through-body construction accommodates interchangeable modules while maintaining the structural integrity of the instrument even when the module is removed.

The foregoing description is to be clearly understood as given by way of illustration and example only, the spirit and scope of this invention being defined by the appended claims and their equivalents.

What is claimed is:

1. An electric stringed instrument comprising:

a body having a front face and a rear face and defining a cavity extending between said front face and said rear face; and a module including one or more pickups, a multi-way switch, a volume control, and a tone control for producing a sound, said module being removably securable into said cavity through said rear face of said body.

2. The electric stringed instrument of claim 1, wherein said cavity includes a perimeter defining a shape and said module is of substantially the shape of said cavity.

3. The electric stringed instrument of claim 1, comprising a plurality of removably insertable modules, each of which provides a regrouping of pickups and electronic components.

4. The electric stringed instrument of claim 3, wherein each of said modules comprises a pickup, a multi-way switch, a volume control, a tone control, a jack, and electrical wiring.

5. The electric stringed instrument of claim 4, wherein each of said modules comprises a plurality of pickups.

6. The electric stringed instrument of claim 2, further comprising means for limiting the insertion of said module into said cavity.

7. The electric stringed instrument of claim 6, wherein the limiting means comprises a flange extending about said perimeter of said cavity adjacent said front face of said body.

8. The electric stringed instrument of claim 1, further comprising an electrical grounding mechanism which is activated by insertion of said module into said cavity.

9. The electric stringed instrument of claim 1, wherein said body is composed of a material selected from the group consisting of wood, plastics, metals, fiberglass, graphite and composite materials.

10. The electric stringed instrument of claim 1, wherein said module comprises a front face which is substantially contiguous with said front face of said body and provides a pick guard when said module is inserted in said cavity.

11. The electric stringed instrument of claim 1, further comprising means for removably retaining said module in said cavity.

12. The electric stringed instrument of claim 11, wherein the retaining means comprises a plurality of resiliently-biased latches provided on said module and a resiliently biased latch provided on said body.

13. The device as in claim 1 further comprising a jack and electrical wiring located on said module.

14. An electric guitar comprising:

a body having a front face and a rear face and defining a cavity extending between said front face and said rear face;

a module comprising a plurality of pickups, a multi-way switch, a volume control, a tone control, a jack and electrical wiring, said module being removably insertable in said cavity through said rear face of said body; and means for removably retaining said module in said body.

15. The electric guitar of claim 14, further comprising an electrical grounding mechanism.

16. The electric guitar of claim 14, wherein said module comprises a front face which provides a pick guard when inserted in said cavity.

17. The electric guitar of claim 14, wherein the retaining means comprises a plurality of resiliently-biased latches provided on said module.

18. The electric guitar of claim 14, wherein said body comprises strings provided on said front face, a flange which extends into said cavity, said flange having a bottom face, said module having a front face which abuts said bottom face and is substantially contiguous with said front face of said body when said module is inserted in said cavity, and said pickups being positioned adjacent said strings.

19. An electric stringed instrument comprising:

a body having a first front face and a first rear face and defining a cavity extending between said first front face and said first rear face, said cavity having a first sidewall; and a module having a second front face and a second rear face integrally joined by a second sidewall, including one or more pickups and electronic components, said module being removably securable into said cavity through said first rear face of said body; and one or more resiliently-biased latches located on said second sidewall for engaging said first sidewall for removably retaining said module in said body.

20. The device as in claim 19 wherein said module comprises one or more pickups, a multi-way switch, a volume control, and a tone control.

21. The device as in claim 19 further comprising means for limiting the insertion of said module into said cavity.

22. The device as in claim 21, wherein the limiting means comprises a flange extending about said perimeter of said cavity adjacent said first front face of said body.

* * * * *